United States Patent [19]

Benolkin

[11] 3,998,416

[45] Dec. 21, 1976

[54] TOOL HOLDER AND PAINT CAN SUPPORT

[76] Inventor: James R. Benolkin, 6507 N. Ewing Ave., Brooklyn Center, Minn. 55429

[22] Filed: Jan. 26, 1976

[21] Appl. No.: 652,069

[52] U.S. Cl. ..... 248/210; 248/246

[51] Int. Cl.[2] ..... E06C 7/14

[58] Field of Search ..... 248/210, 211, 238, 245, 248/246

[56] References Cited

UNITED STATES PATENTS

| | | | |
|---|---|---|---|
| 1,221,658 | 4/1917 | Berry | 248/210 |
| 1,551,243 | 8/1925 | Dick | 248/210 |
| 1,940,157 | 12/1933 | Tucker | 248/210 |
| 2,056,527 | 10/1936 | Kummer | 248/210 |
| 2,236,187 | 3/1941 | Penney | 248/210 X |
| 2,634,937 | 4/1953 | Welsh | 248/211 |
| 2,686,033 | 8/1954 | Keiter | 248/211 |
| 3,104,859 | 9/1963 | Hoelzel | 248/210 |
| 3,239,181 | 3/1966 | Ellerbrock | 248/210 |
| 3,357,668 | 12/1967 | Carrel | 248/210 |
| 3,627,245 | 12/1971 | Lewis | 248/210 |

FOREIGN PATENTS OR APPLICATIONS

| | | | |
|---|---|---|---|
| 422,259 | 4/1967 | Switzerland | 248/246 |
| 855,081 | 11/1960 | United Kingdom | 248/210 |

*Primary Examiner*—Lawrence J. Staab
*Attorney, Agent, or Firm*—Jacobson and Johnson

[57] ABSTRACT

A ladder bracket for supporting both paint cans and tools. The ladder bracket is quickly and easily mounted in a level position on the side of the ladder by a self-tightening elastic strap and a self-leveling stop. The bracket contains a working surface having openings and hooks for holding tools as well as a pair of fingers for holding a paint pail and a paint brush so that the paint from the brush will drip into the paint pail.

5 Claims, 2 Drawing Figures

FIG. 1
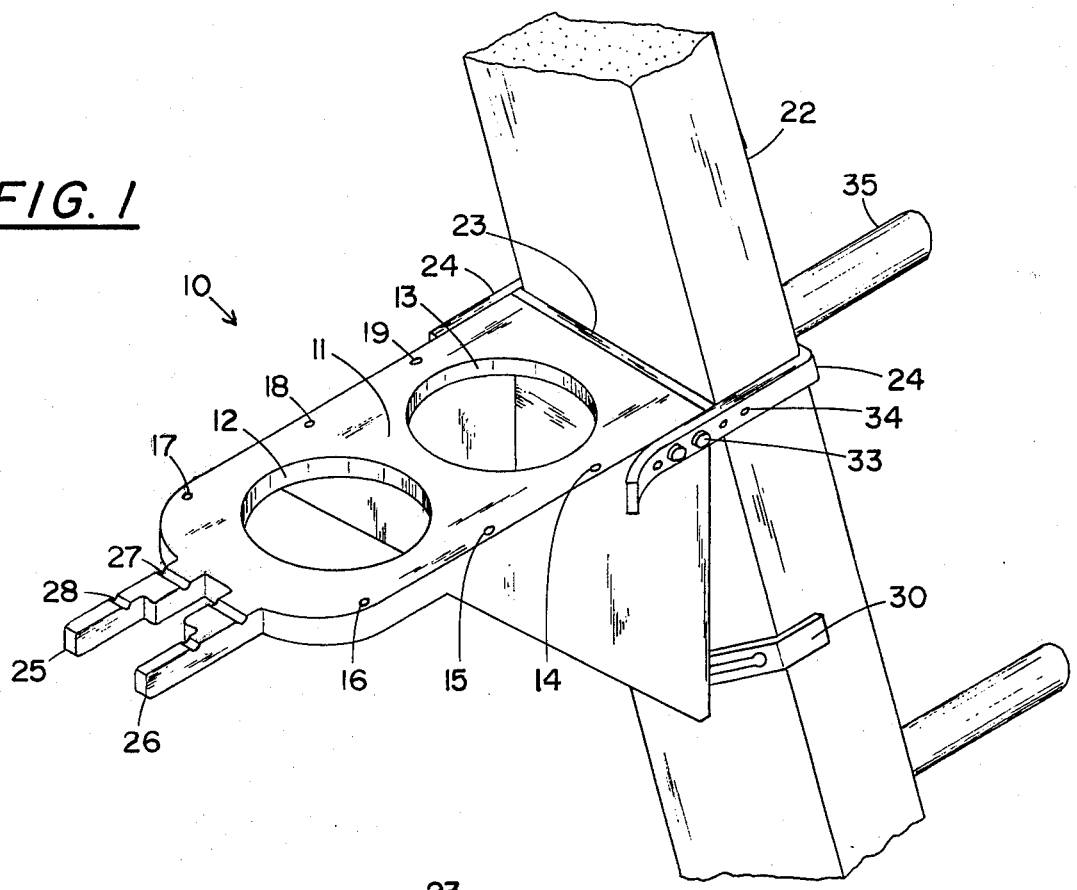
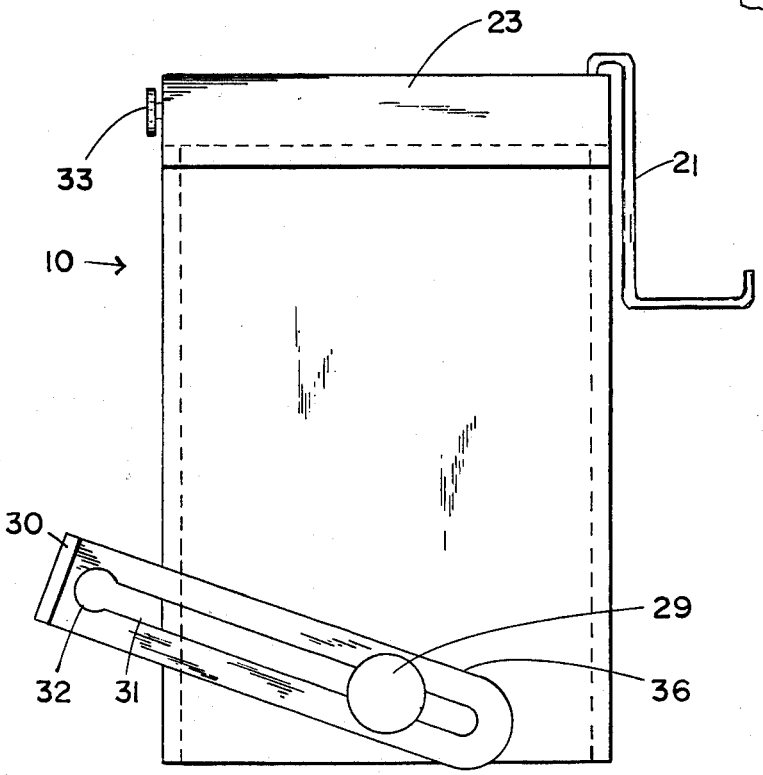
FIG. 2

TOOL HOLDER AND PAINT CAN SUPPORT

BACKGROUND OF THE INVENTION

1. Field of the Invention

This invention relates generally to improvements to attachments to ladders for holding paint pails and tools within easy reach of an operator working on a ladder.

2. Description of the Prior Art

A person working on the ladder painting or the like, generally requires some type of a device for holding a paint pail or other small tools. For example, a painter will often have a scraper or wire brush and a hammer with him as he works. The scraper or wire brush is for removing blistered paint and the hammer is for driving in any loose nails.

There are a number of hangers and brackets available; however, most of them are very specialized and complex and do not serve the dual purpose of holding a paint brush and a paint pail as well as other articles. For example, there are some devices such as shown in the Emmons U.S. Pat. No. 3,822,847 which comprise a simple tray for fastening onto the side of a ladder. The Tucker U.S. Pat. No. 1,940,157 shows a paint can holder and brush holder with a chain for attaching the holder to the ladder. The Ellerbrock U.S. Pat. No. 3,239,181 shows a member which rigidly fastens to the side of the ladder and allows the paint pail to sit in a swinging bracket. The Crossman U.S. Pat. No. 3,182,943 shows a clamping mechanism which has screw clamps to hold the bracket on the side of the ladder. The Dick U.S. Pat. No. 1,551,243 shows a member which slips over the rung and side of the ladder. The Myers U.S. Pat. No. 1,455,221 shows another variation of a paint pail holder in which a screw clamp holds an arm to the side of the ladder. In addition, the Carrel U.S. Pat. No. 3,357,668 shows a combination device that can be used for holding tools or a paint pail but not at the same time.

BRIEF DESCRIPTION OF THE DRAWING

FIG. 1 shows my tool holder and paint can support mounted on a ladder rail; and

FIG. 2 is an end view of my invention.

SUMMARY OF THE INVENTION

The present invention comprises a combination paint pail holder and tool holder which has an elastic strap that mounts around the side of the ladder. The weight of the holder and the guide provide a self-leveling action which twists the elastic strap to form a tight, secure mounting of the holder to the ladder.

BRIEF DESCRIPTION OF THE PREFERRED EMBODIMENT

Referring to the drawing, reference numeral 10 generally designates my tool and paint pail holder which is a bracket holder for mounting to the side of the ladder. Bracket holder 10 comprises a top platform 11 having openings 12 and 13 therein for inserting a large tool such as a plier, hammer or the like. Located in top platform 11 are a series of smaller holes 14, 15, 16, 17, 18 and 19 which are for receiving an eye or a hook 21 (FIG. 2) for hanging other articles. Typically, holes 14, 15, 16, 17, 18 and 19 have a tapered opening so that when one end of hook member is placed therein, it is wedged securely in the opening and will not fall out as the ladder is moved.

Located at one end of the platform 11 are a pair of fingers 25 and 26. Fingers 25 extend outward in a spaced parallel relationship to hold a paint pail, as well as supporting a paint brush therebetween. The paint pail handle is inserted in either slot 27 or slot 28 to prevent the pail from sliding off fingers 25 and 26. The fat part of the brush handle is placed between and above fingers 25 and 26 and the bristles are located below fingers 25 and 26. The fat part of the brush handle prevents the brush from sliding between fingers 25 and 26. Meanwhile, any paint in the bristles will drip in the pail which is held below the brush by fingers 25 and 26. Fingers 25 and 26 provide different spacings therebetween so that the invention can accommodate two different sizes of brushes.

Located on the opposite end of the platform 11 is a rubber or elastic backing strip 23 which abuts against one side of ladder rail 22. A second elastic member 24 is securely fastened to one side of bracket holder 10 and removably fastened to the other side through openings 34 which fit on circular pins 33 which have enlarged heads. To utilize elastic member 24, the operator slips elastic member 24 from around member 33 and places it around ladder rail 22 and above rung 35. He then secures bracket holder 10 to ladder rail 22 by placing opening 34 in elastic band 24 over pin member 33. After bracket 10 has been secured to the ladder, the operator places the end 30 of adjustable guide 36 (FIGS. 1 and 2) in contact with ladder rail 22. Adjustable guide 36 is fastened to bracket 10 by a member 29 which allows guide 36 to slide along slot 31. Adjustable guide 36 is self-leveling and has an L shaped hook 30 for fastening on the side of the ladder rail 22 to allow bracket 10 to swing to a horizontal position. Located within adjustable guide 36 is an elongated slot 31 and a circular opening 32 which can either be larger than head 29 to allow the adjustable guide to be taken off and inserted on the holder or member 29 can have a larger head if it is removably mounted to bracket holder 10. However, in either event, guide 36 is free to slide along member 29.

A unique advantage of my invention is that to mount my bracket to ladder rail 22, one aligns bracket holder 10 with ladder rail 22. However, when in use, bracket holder 10 swings downward, thus twisting and tightening the elastic band 24 around ladder rail 22, thereby tightening and securely holding ladder bracket 10 to rail 22. Any further twisting of bracket holder 10 is prevented by guide 36.

I claim:

1. A tool and paint can holder for mounting on a ladder rail comprising:

a holding member having a first surface for abutting against a ladder rail and a second surface having an opening therein for receiving tools, a pair of fingers projecting from said holding member, said pair of fingers having means for holding a paint pail thereon, said fingers spaced sufficiently apart to engage the handle of a brush so that a brush can be hung, bristles down, over a paint pail mounted in said means on said fingers;

a guide member, movable, mounted to said holding member for engaging a ladder rail to thereby secure said second surface of said holding member in a horizontal position;

an elastic member connected to said holding member for encircling said ladder rail and mounting said holding member to the ladder rail, said elastic member self-tightening as said second surface of said holding member is positioned in a horizontal position.

2. The invention of claim 1 wherein said means of said pair of fingers comprise recess regions therein for holding a paint pail.

3. The invention of claim 2 wherein said guide member contains a slot for slidably engaging a fastening member on said holder.

4. The invention of claim 3 wherein said holding member has a hook extending therefrom.

5. The invention of claim 4 wherein said holding member includes a second elastic member for abutting against a ladder rail.

* * * * *